US005259290A

United States Patent [19]

Pehker

[11] Patent Number: 5,259,290

[45] Date of Patent: Nov. 9, 1993

[54] AMMUNITION CONTAINER

[75] Inventor: Manfred Pehker, Düsseldorf, Fed. Rep. of Germany

[73] Assignee: Rheinmetall GmbH, Ratingen, Fed. Rep. of Germany

[21] Appl. No.: 921,635

[22] Filed: Jul. 30, 1992

[30] Foreign Application Priority Data

Aug. 8, 1991 [DE] Fed. Rep. of Germany ..... 4126199

[51] Int. Cl.[5] ..... F42B 39/08

[52] U.S. Cl. ..... 89/35.01; 89/45

[58] Field of Search ..... 89/35.01, 33.14, 33.16, 89/45, 46, 34

[56] References Cited

U.S. PATENT DOCUMENTS

| | | | |
|---|---|---|---|
| 1,552,863 | 9/1925 | Methlin . | |
| 1,907,342 | 5/1933 | Capell . | |
| 2,972,934 | 2/1961 | Platt et al. | 89/46 |
| 2,988,962 | 6/1961 | Finn | 89/46 |
| 3,501,996 | 3/1970 | Lipp et al. | 89/46 |
| 4,125,052 | 11/1978 | Thomas | 89/34 |
| 4,619,181 | 10/1986 | Pehker et al. | 89/34 |

FOREIGN PATENT DOCUMENTS

| | | | |
|---|---|---|---|
| 3046642 | 7/1982 | Fed. Rep. of Germany . | |
| 574351 | 1/1946 | United Kingdom | 89/35.01 |

*Primary Examiner*—Stephen M. Johnson

*Attorney, Agent, or Firm*—Spencer, Frank & Schneider

[57] ABSTRACT

An ammunition container (1) for large caliber ammunition (2) includes two shells (5, 6) that are arranged parallel to the ammunition, with one shell (5) being fixed and the other shell (6) being movable. A rotatable control lever (7, 7') is mounted at least one end (10, 11) of the ammunition container (1), the control lever having a pivot axis that coincides with the longitudinal axis (12) of the ammunition container (1). The movable shell (6) and the control lever (7, 7') are connected with one another by way of a releasable holding mechanism (9) so that, upon pivoting of the control lever (7, 7') from an open position to a closed position, the movable shell (6) also rotates about the longitudinal axis (12) of the ammunition container. In addition, the control lever (7, 7') has a cam (70) on which the movable shell (6) is mounted so as to be freely rotatable. The cam (70) causes the movable shell to be pressed radially against the ammunition (2) when the control lever (7, 7') is pivoted beyond the closed position. A magazine belt can be made from a plurality of such ammunition containers. The ammunition can be removed from the belt at any desired position, and moreover the ammunition can readily be clamped in the individual containers of the belt.

6 Claims, 5 Drawing Sheets

AMMUNITION CONTAINER

BACKGROUND OF THE INVENTION

The present invention relates to an ammunition container for large caliber ammunition, particularly armored vehicle ammunition. In more detail, the invention relates to an ammunition container of the type wherein large caliber ammunition is held by at least two shells arranged parallel to the ammunition, with one shell being fixed and the other shell being movable. The invention also relates to the use of such ammunition containers in magazine belts, particularly for ammunition having combustible casings.

A significant problem involved with the storage of large caliber ammunition having thin-walled casings (particularly combustible casings) in ammunition containers for magazine belts is that this ammunition must be tied down securely (lashed) in the containers when the vehicle travels through uneven terrain. Otherwise the ammunition may become prematurely defective and thus useless due to shaking.

DE 3,046,642.A2 discloses ammunition containers composed of two shell halves which enclose the ammunition, with one of the shells being a fixed shell and the other a movable shell. This ammunition container does not provide for tying down the ammunition.

U.S. Pat. No. 4,619,181 discloses an ammunition container which is essentially composed of one half shell. In the region of the projectile head and the casing bottom, separate holding clamps are provided to tie down the ammunition. The drawback of this arrangement is, however, that the ammunition can be removed only at the points where the ammunition belt reverses since the holding clamps permit only a limited opening angle.

SUMMARY OF THE INVENTION

It is therefore an object of the present invention to provide ammunition containers which can be assembled on a rotating magazine belt, in which the removal and insertion of the ammunition from the outside can take place essentially at any desired position of the magazine belt and the ammunition can individually be tied down or clamped in the individual containers. Another object is to provide ammunition containers which permit the magazine belt made from such containers to be guided in any desired direction.

The invention is essentially based on the concept of providing a two-stage motion sequence for loading the ammunition containers. In the first stage the movable shell is placed around the ammunition in the circumferential direction so that the ammunition is disposed between the two shells. In the second stage the movable shell is then moved radially toward the ammunition so that the ammunition is firmly clamped between the shells.

This two-stage motion sequence is realized with the aid of a control lever whose pivot axis coincides with the longitudinal axis of the ammunition container. The control lever has a cam. The control lever is connected with the movable shell by way of a releasable holding mechanism in such a manner that the shell is rotated along when the control lever is pivoted from an open position to a closed position (a position in which the two shells are disposed approximately opposite one another). On the other hand, the movable shell is arranged to be freely rotatable on the cam of the control lever so that, after the holding mechanism has been released, continued pivoting of the control lever to a clamping position causes the movable shell to be moved in the direction of the ammunition. Preferably the further pivoting of the control lever takes place automatically by means of a pre-tensioned torsion spring so that a predetermined contact pressure is ensured.

DESCRIPTION OF THE PREFERRED EMBODIMENT

Figure 1:
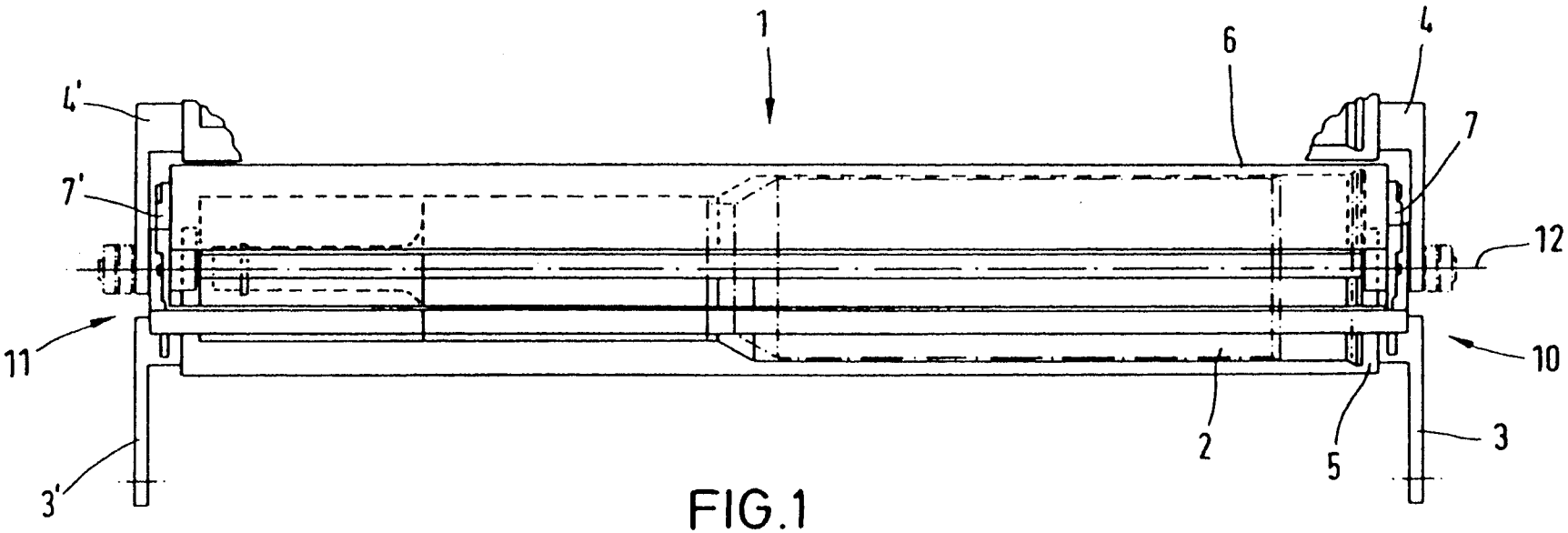
FIG. 1 is a side view of an ammunition container according to the invention with inserted ammunition.

In FIG. 1, the ammunition container according to the invention is marked 1; ammunition 2 is stored in it. Reference numerals 3 and 3' and 4 and 4' identify chain links by means of which the ammunition container 1 can be connected with adjacent identical ammunition containers of a magazine belt.

Ammunition container 1 is composed essentially of a fixed shell 5 and a movable shell 6. The shape of shells 5 and 6 is adapted to the ammunition 2 to be stored (in the illustrated example, ammunition 2 is a HEAT or high explosive anti-tank cartridge). At the ends 10 and 11 of ammunition container 1, two control levers 7 and 7' are indicated. These levers will be described in greater detail below. The longitudinal axis of ammunition container 1 is marked by reference numeral 12.

Figure 2:
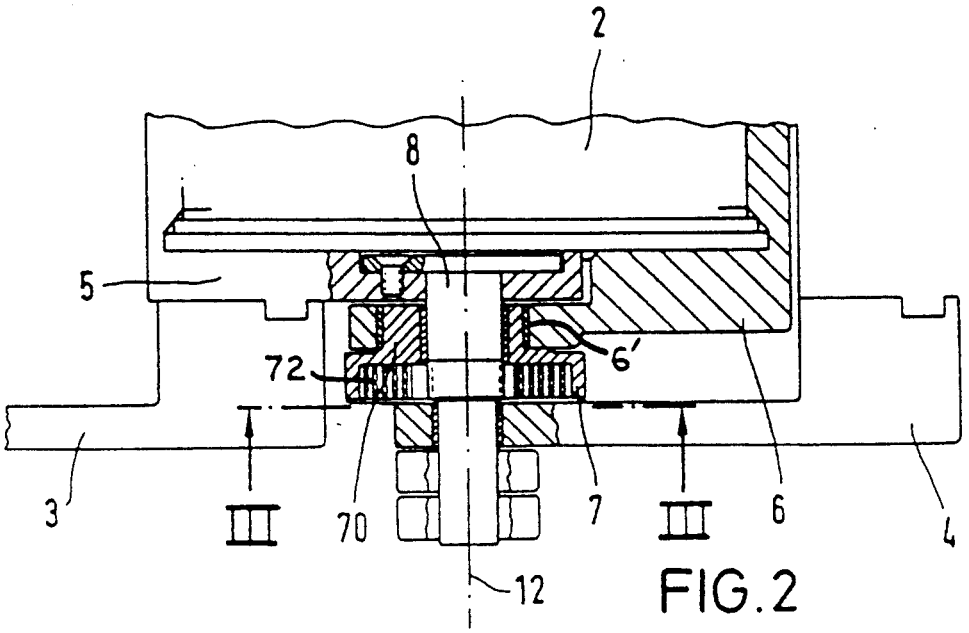
FIG. 2 is a cross-sectional view of a container according to FIG. 1 in the region of the casing bottom of the ammunition.

FIG. 2 is a cross-sectional view of ammunition container 1 in the region of end 10, the end of the container in which the cartridge bottom of ammunition 2 is disposed. The same reference numerals are employed here for the same components as in FIG. 1. Reference numeral 8 identifies a flange pin which is attached to fixed shell 5. The lever 7 is pivotal around flange pin 8 about an axis coinciding with the longitudinal axis 12 of ammunition carrier 1. A torsion spring 72 biases lever 7 with respect to flange pin 8. Lever 7 is provided with a cam 70 which extends through a circular opening 6' in movable shell 6. Cam 70 is rotatable with respect to opening 6'.

Figure 3:
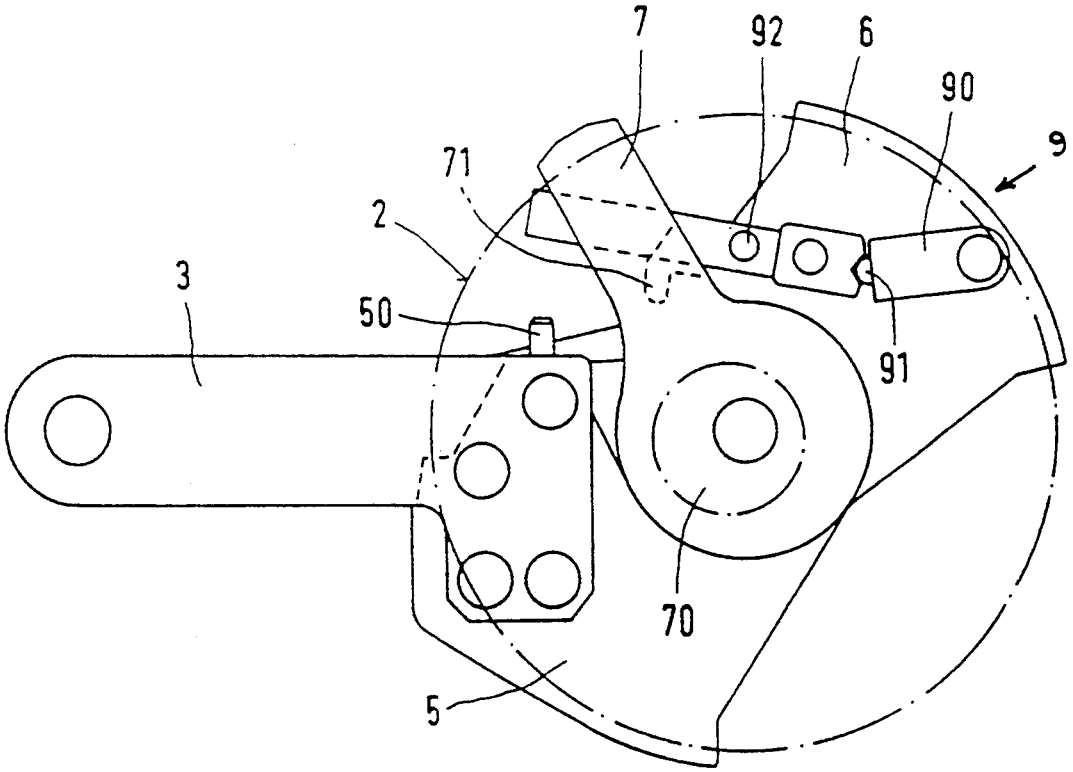
FIG. 3 is an end view of the ammunition container seen along the line III—III in FIG. 2.

An end view of end 10 of ammunition container 1, as seen along the section line marked III—III, is shown in FIG. 3. The control lever 7 has a detent groove 71. The control lever 7 is connected with movable shell 6 by way of a releasable holding mechanism or rocker detent 9.

Rocker detent 9 is essentially composed of a rocker lever 90 which includes a joint 91 and a detent pin 92. As will be described in greater detail below with reference to FIGS. 5*a* to 5*d*, when control lever 7 is pivoted in a counterclockwise direction (with respect to FIG. 3)

from an open position to a closed position, the detent pin 92 engages in the detent groove 71 of control lever 7 in a force-transmitting manner so as to pivot movable shell 6 from a corresponding open position to a corresponding closed position. This closed position is reached when rocker lever 90 arrives at a stop 50. Stop 50 causes detent pin 92 of rocker lever 90 to slide out of detent groove 71.

Upon further counterclockwise rotation of control lever 7, the movable shell 6 therefore no longer rotates along but, due to its arrangement on cam 70, is pressed against the ammunition 2 (which is shown in dashed lines in FIG. 3). The torsion spring 72 (not shown in FIG. 3) is permanently tensioned and takes care that the ammunition is essentially automatically clamped in and also that it is retained in this position.

Figure 4A:
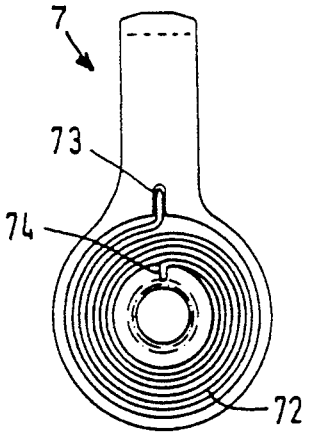
FIGS. 4*a* to 4*c* are a front, side, and rear view, respectively, of a control lever that can be used to pivot the movable shell.
Figure 4B:
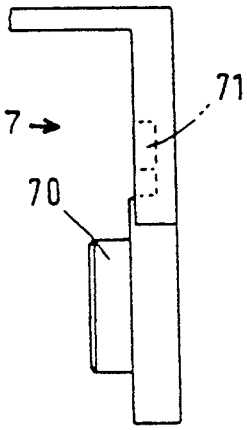
Figure 4C:
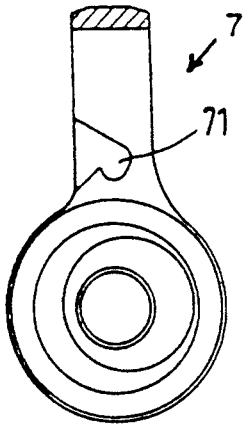

The structure of the control lever 7 is shown in FIGS. 4*a* to 4*c*. FIG. 4*a* shows the torsion spring 72, which is configured as a coil spring and is disposed in the interior of control lever 7. The first end 73 of torsion spring 72 is fastened to control lever 7 and the second end 74 to flange pin 8 (FIG. 2). FIGS. 4*b* and 4*c* clearly show detent groove 71 and cam 70.

The operation of the control lever will now be described in greater detail with reference to FIGS. 5*a* to 5*d*.

Figure 5A:
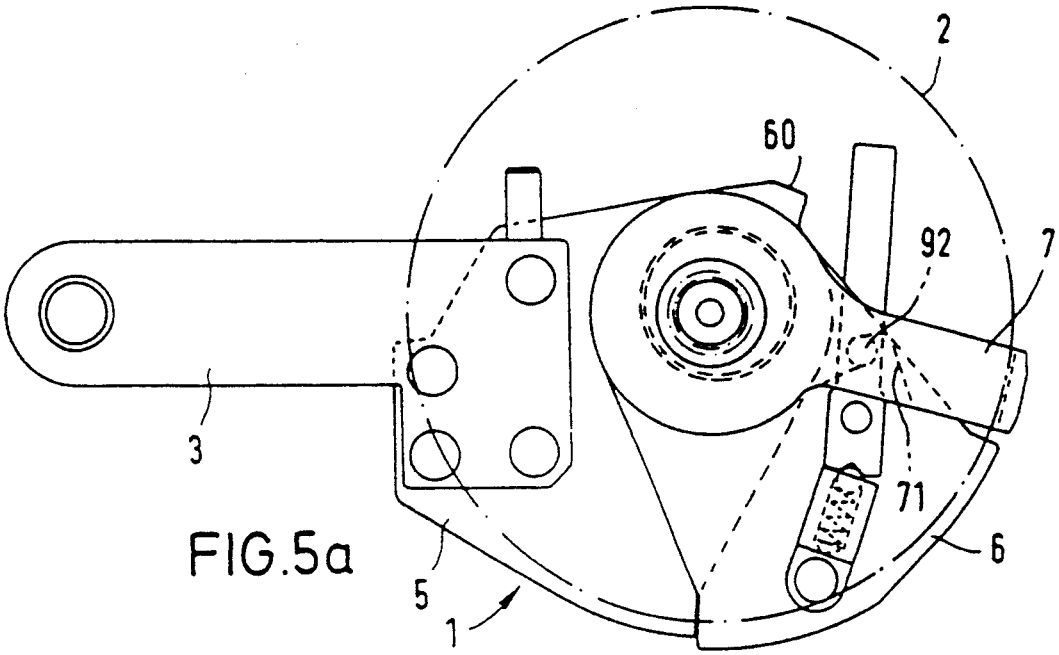
FIGS. 5*a* to 5*d* are end views showing various operating states of the ammunition container according to the invention.

FIG. 5*a* shows the ammunition container 1 with control lever 7 in its open position. The two shells 5 and 6 lie close to one another and together form at most half of a cylinder so that the ammunition 2 can be removed from the container or placed into the container. Hereinafter it will be assumed that container 1 has been loaded with ammunition 2 and can now be closed and the ammunition can be tied down.

Figure 5B:
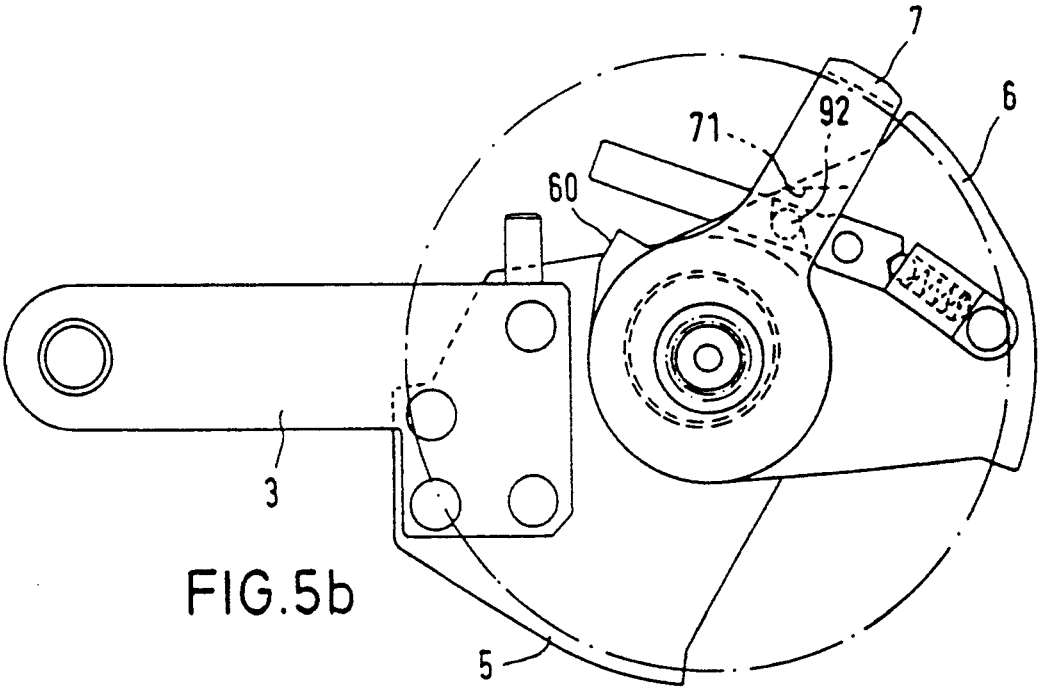

For this purpose, control lever 7 is pivoted counterclockwise. As can be seen in FIG. 5*b*, rotation of control lever 7 also rotates movable shell 6 since detent pin 92 is in force-transmitting engagement in detent groove 71. During this movement, cam 70 and opening 6' (FIG. 2) rotate in unison.

Figure 5C:
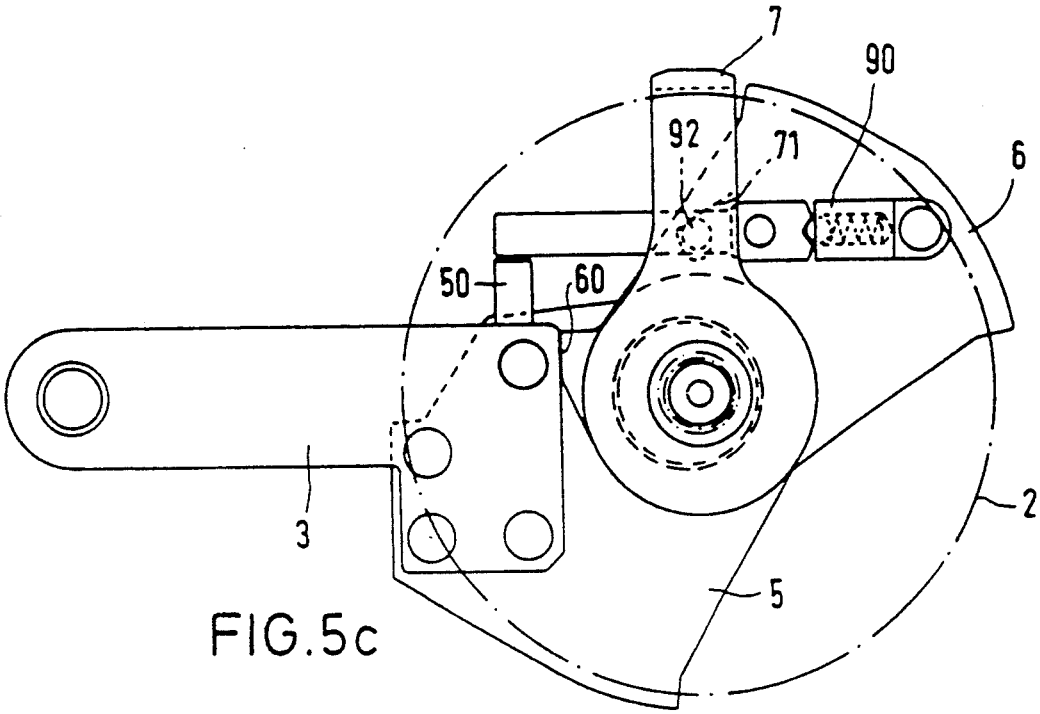
Figure 5D:
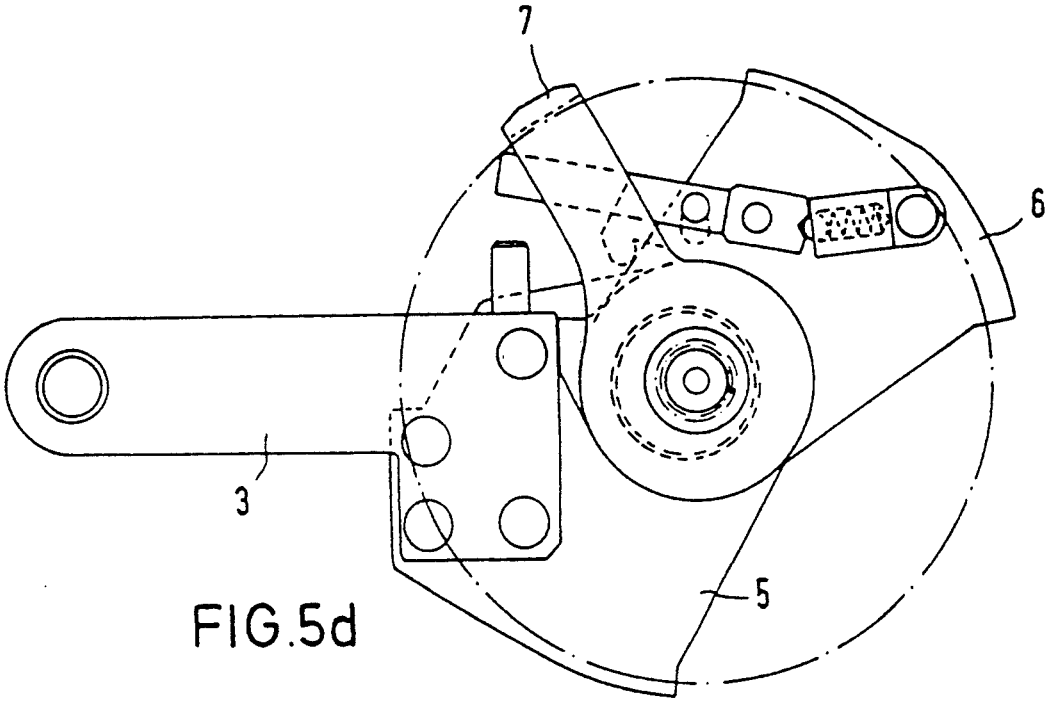

In FIG. 5*c* control lever 7 is shown in its closed position. Rocker lever 90 has reached the stop 50, and a stop 60 on movable shell 6 has reached chain link 3 (in this position, the fixed shell 5 and the movable shell 6 are disposed opposite one another). This causes detent pin 92 to slide out of detent groove 71. Cam 70 is now free to rotate within opening 6' (FIG. 2). Driven by torsion spring 72, control lever 7 pivots until movable shell 6 encloses ammunition 2 without play (FIG. 5*d*), with cam 70 forcing movable shell 6 toward fixed shell 5 to clamp ammunition 2 between the shells. FIG. 5*d* shows control lever 7 in its clamping position.

During opening of movable shell 6, control lever 7 is turned back again by means of an external drive (not shown). The spring 72 is tensioned and the movable shell 6 is carried along until it reaches its starting position (FIG. 5*a*). By means of an appropriate holding device (also not shown) movable shell 6 can be locked in its starting position.

During the loading of ammunition, the lock is released and the tie-down or clamping process takes place automatically.

The process described for control lever 7 takes place in synchronism also for control lever 7' so that this lever need not be discussed in greater detail.

Figure 6:
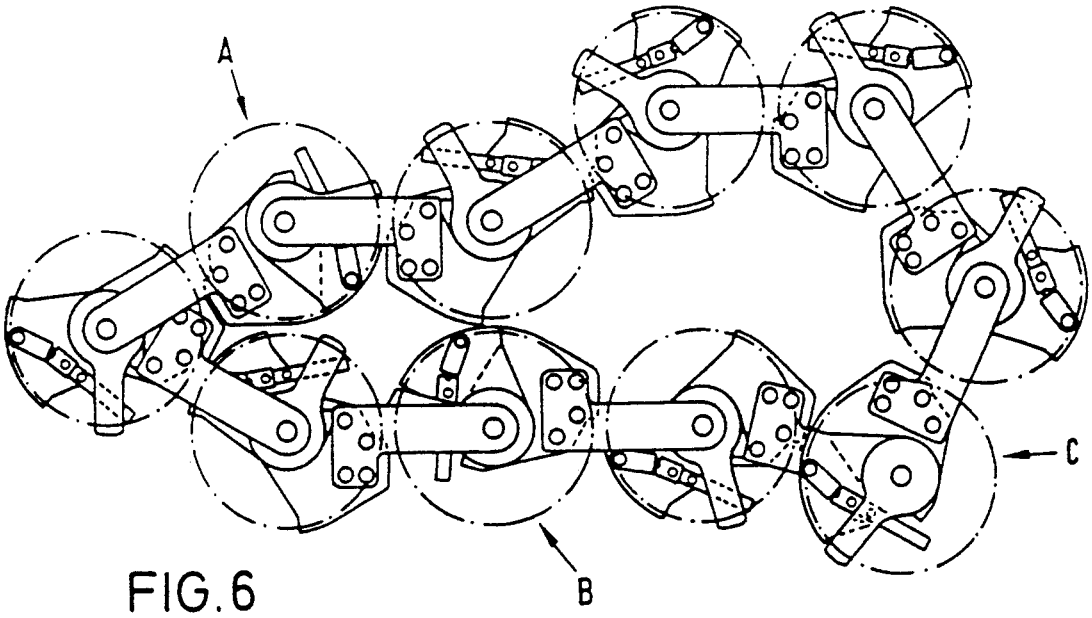
FIG. 6 is an end view illustrating an example of a magazine belt composed of the ammunition containers according to the invention, and shows possible removal positions.

FIG. 6 shows a magazine chain composed of ten ammunition containers. The letters A, B and C identify possible ammunition removal positions. As can be seen in this figure, if ammunition containers according to the present invention are employed in a magazine chain it is possible (in contrast to the above-noted U.S. Pat. No. 4,619,181) to remove ammunition not only at positions near the outer reversal points but also, for example, at the linear belt sections.

It will be understood that the above description of the present invention is susceptible to various modifications, changes, and adaptations, and the same are intended to be comprehended within the meaning and range of equivalents of the appended claims.

What I claim is:

1. An ammunition container for large caliber ammunition, the ammunition container having an end and a longitudinal axis which extends through the end, said ammunition container comprising:

a fixed shell extending parallel to the ammunition;

a movable shell extending parallel to the ammunition;

a control lever mounted at the end of the ammunition container, the control lever being pivotal about the longitudinal axis of the ammunition container;

releasable holding means for releasably connecting the control lever to the movable shell so that, if the control lever is pivoted in a predetermined direction from an open position to a closed position, the movable shell pivots along with the control lever about the longitudinal axis of the ammunition container; and cam means on the control lever for pressing the movable shell radially against the ammunition if the control lever is rotated past the closed position in the predetermined direction to a clamping position.

2. The ammunition container of claim 1, further comprising spring means for urging the control lever in the predetermined direction.

3. The ammunition container of claim 1, wherein the control lever has a detent groove, and wherein the releasable holding means comprises a rocker detent which is mounted on the movable shell and which includes a detent pin to engage the detent groove.

4. The ammunition container of claim 1, wherein the two shells are disposed adjacent one another and together form a concave cradle for removing or loading ammunition when the control lever is in its open position, the concave cradle extending around an arc of not more than 180°.

5. A magazine belt, comprising:

a plurality of ammunition containers for large caliber ammunition, the ammunition containers being connected together, each ammunition container having an end and a longitudinal axis which extends through the end, each ammunition container including a fixed shell extending parallel to the longitudinal axis of the respective ammunition container;

a movable shell extending parallel to the longitudinal axis of the respective ammunition container;

a control lever mounted at the end of the respective ammunition container, the control lever being pivotal about the longitudinal axis of the respective ammunition container;

releasable holding means for releasably connecting the control lever to the movable shell so that, if the control lever is pivoted in a predetermined direction from an open position to a closed position, the movable shell pivots along with the control lever about the longitudinal axis of the respective ammunition container; and cam means on the control lever for pressing the movable shell radially against the ammunition if the control lever is rotated past the closed position in the predetermined direction to a clamping position.

6. A magazine belt, comprising:

a plurality of ammunition containers for large caliber, combustible casing ammunition, the ammunition containers being connected together, each ammunition container having an end and a longitudinal axis which extends through the end, each ammunition container including a fixed shell extending parallel to the longitudinal axis of the respective ammunition container;

a movable shell extending parallel to the longitudinal axis of the respective ammunition container;

a control lever mounted at the end of the respective ammunition container, the control lever being pivotal about the longitudinal axis of the respective ammunition container;

releasable holding means for releasably connecting the control lever to the movable shell so that, if the control lever is pivoted in a predetermined direction from an open position to a closed position, the movable shell pivots along with the control lever about the longitudinal axis of the respective ammunition container; and cam means on the control lever for pressing the movable shell radially against the ammunition if the control lever is rotated past the closed position in the predetermined direction to a clamping position.

* * * * *